United States Patent [19]

Morbitzer et al.

[11] 4,398,464

[45] Aug. 16, 1983

[54] REVERSIBLE-DRIVE OFFSET ROTARY PRINTING MACHINE

[75] Inventors: Rudolf Morbitzer, Augsburg; Werner Kleininger, Neusäss, both of Fed. Rep. of Germany

[73] Assignee: M.A.N. -Roland Druckmaschinen Aktiengesellschaft, Offenbach am Main, Fed. Rep. of Germany

[21] Appl. No.: 323,259

[22] Filed: Nov. 20, 1981

[30] Foreign Application Priority Data

Dec. 23, 1980 [DE] Fed. Rep. of Germany ..... 3048840

[51] Int. Cl.[3] ..... B41F 7/10

[52] U.S. Cl. ..... 101/177; 101/180; 101/182; 101/221

[58] Field of Search ..... 101/137, 138, 139, 142, 101/177, 179, 180, 181, 182, 220, 221, 225, 216

[56] References Cited

U.S. PATENT DOCUMENTS 3,329,086 7/1967 Pullen ..... 101/177

4,281,595 8/1981 Fujishiro ..... 101/180 X

FOREIGN PATENT DOCUMENTS 23039 1/1981 European Pat. Off. ..... 101/177

*Primary Examiner*—J. Reed Fisher

*Attorney, Agent, or Firm*—Frishauf, Holtz, Goodman & Woodward

[57] ABSTRACT

To provide for change of direction of rotation of the impression cylinders in a 10-cylinder printing system, and selective operation of blanket-impression cylinder or blanket-blanket printing, at least some of the gears driving the cylinders are axially shiftable, and rotation-reversal gears can be selectively switched in position with respect to drive power to drive, directly, from a main shaft (11), the one impression cylinder (2) with further drive (22) of the second impression cylinder (1), directly or via a second rotation-reversal gear (19); or, for blanket-to-blanket operation, disengagement of the rubber blankets from the impression cylinders by shifting-away of the centers of rotation thereof, and drive from the main drive shaft of the respective rubber cylinders through plate cylinders (9, 10) closest to the main drive train, and subsequent drive of rubber cylinders (5, 6; 3, 4) and the associated plate cylinders (7, 8) through the rubber cylinder—rubber cylinder plate cylinder system.

10 Claims, 5 Drawing Figures

REVERSIBLE-DRIVE OFFSET ROTARY PRINTING MACHINE

Figure 1:
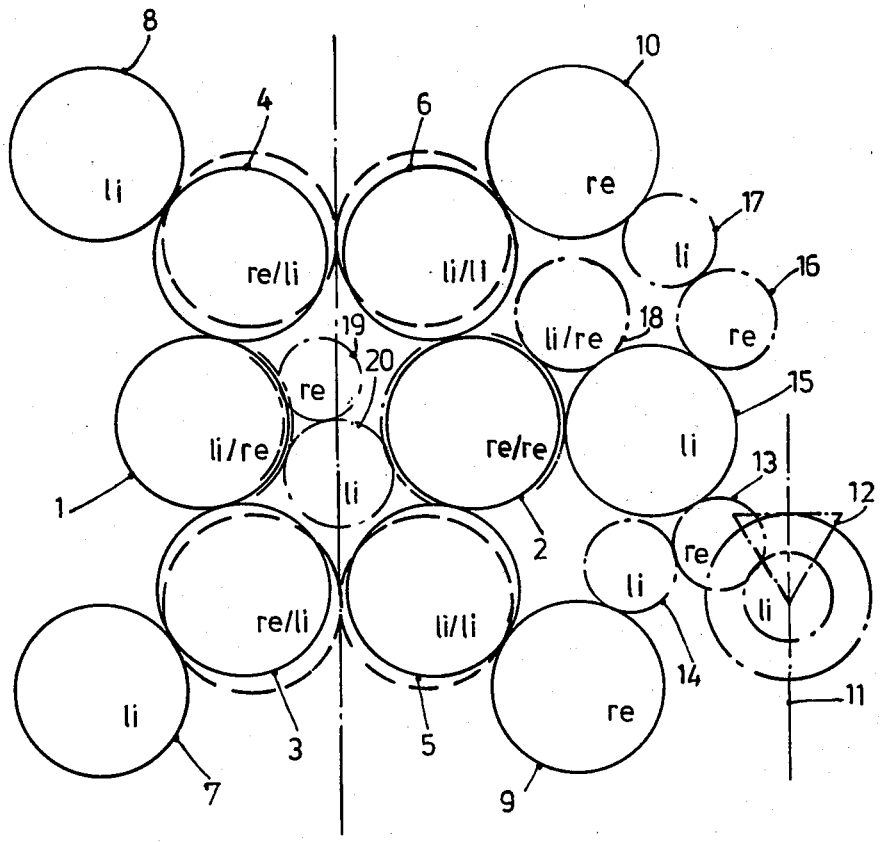

The present invention relates to a rotary offset printing machine in which the drive direction of rotation of the respective cylinders can be changed, and in which a 10-cylinder printing station is provided which, selectively, permits printing with blanket cylinders as the counter or impression or printing cylinders, or with a separate printing or impression cylinder.

BACKGROUND 10-cylinder printing machines have previously been proposed; it is also known to provide 10-cylinder printing machines with, selectively, different directions of rotation of the printing cylinders and selective operation of the cylinders such that either rubber blanket cylinder cooperate with printing or impression cylinders as a counter, or with another blanket cylinder as the impression or printing cylinder (see German Patent Disclosure Document DE-OS No. 29 51 249). Such a 10-cylinder configuration provides for a central location of the impression or printing cylinders, with two blanket cylinders selectively positionable against the impression cylinders; each one of the blanket cylinders has a plate cylinder associated therewith. Selectively, the blanket cylinders can move into contact with each other so that blanket-to-blanket printing also is possible. The drive of such a 10-cylinder printing system is obtained over a gear drive train with drive gears secured to the shafts of the respective cylinders; the drive gears can be fixed on a shaft or, on some of them, can be movable; to shift direction of rotation of the cylinders, clutches which can be remotely controlled are used.

Use of clutches to, selectively, engage specific gear wheels of the printing cylinders is expensive and takes up space.

THE INVENTION

It is an object to provide a 10-cylinder printing system or printing machine having such a system, in which the direction of rotation can be selectively changed without, however, using clutches.

Briefly, in accordance with the invention, a main drive train is provided; a first rotation-reversal gear is located in rotation-transmitting position with respect to the main drive train. Each one of the cylinders have drive gears associated therewith; the drive gear on the first impression cylinder is, selectively, engageable directly with the main train or via the first rotation-reversal gear. A further drive gear and a second rotation-reversal gear are drivingly connected with the drive gear of the first impression cylinder. In addition to the main drive train, first and second further drive trains are provided, the first and second further drive trains being selectively engageable with the main drive train. The drive gear on the second impression cylinder is selectively engageable with one of the further drive gears directly or via the second rotation-reversal gear. Two rubber cylinders, together, form a pair, and two such pairs are provided, each one having an associated plate cylinder. The two pairs of the rubber cylinders are located such that the rubber blanket cylinders of the pair are, each, engageable with the respective first and second impression cylinders or out-of-engagement with the impression cylinders and, rather, one of the rubber cylinders of one pair is engageable with a coordinate one of the other. Selectively, two basic modes of operation then become possible:

(a) For rubber blanket cylinder—impression cylinder operation, the drive gears of the pairs of rubber cylinders are selectively engageable with the drive gears of the associated impression cylinder; the plate cylinders of the respective rubber cylinders are in driving engagement with the drive gears of the associated rubber cylinder.

(b) For rubber cylinder—rubber cylinder (rubber-to-rubber) operation, the first further drive train is selectively engageable with the drive gear of the plate cylinder associated with one of the rubber cylinders of the second pair, the drive gear thereof being engageable with the drive gear of one rubber cylinder of the first pair to form a first extended gear drive branch; and a second further drive train is, selectively, engageable with the drive gear of the plate cylinder associated with the other rubber cylinder of the second pair, the drive gear thereof being engageable with the drive gear of the other rubber cylinder of the second pair.

The arrangement permits selective change of direction of rotation of the respective cylinders without clutches, merely by axially shifting gear wheels on the shafts of the respective cylinders to bring them into properly matching engagement; and, selectively, repositioning the centers of rotation of the shafts of the rubber cylinders to be in our out-of-engagement with the respective impression cylinders or with each other. Such change in position can be accomplished, as is well known, for example by an eccenter bearing positioning arrangement.

The reversal cylinders can also be engaged or disengaged merely by axial shifting of the gears splined, for example, to the shafts, thus permitting elimination of clutches. Preferably, the gears are helical or spirally cut spur gears.

The arrangement of the drive provides for rubber-to-rubber operation with a completely meshing gear train which is of substantial advantage in printing. Furthermore, no clutches need be placed on the shafts of the cylinders, thus permitting elimination of bearings therefor. In rubber-rubber operation, the impression cylinders, which then are not needed, can be used as guide cylinders for the paper passing through the machine.

DRAWINGS

FIG. 1 is a schematic side view representative of a 10-cylinder printing system having two centrally located impression cylinders; and FIGS. 2 to 5 illustrate diagrammatically the gearing train paths to transfer motion from a main drive in accordance with selective axial positioning of respective gears on the shafts of the various cylinders of the printing machine system.

Referring to FIG. 1: Two impression cylinders 1, 2 are essentially centrally located in the printing machine; eight other cylinders, formed of four blanket cylinders and four plate cylinders, are arranged around the impression cylinders 1, 2 in known manner, in approximately star-shaped configuration.

For rubber blanket—impression cylinder operation, two rubber blanket cylinders 3, 4 are in engagement with the impression cylinder 1; each blanket cylinder has a plate cylinder 7, 8 cooperating and associated therewith. Similarly, the impression cylinder 2 has two blanket cylinders 5, 6 engageable therewith, each one of which having an associated plate cylinder 9, 10.

If it is desired to operate the printing system in a blanket-to-blanket mode, then the blanket cylinders which are positioned on one side of the impression cylinders 1, 2 are rocked away from contact with the respective impression cylinders. FIG. 1 shows, in broken line, the rocked-away positions of the blanket cylinders; blanket cylinders 4, 6, while maintaining contact with the respective plate cylinders 8, 10, can be engaged with each other; likewise, blanket cylinders 3, 5 can be rocked about a preferably circular, short path to maintain engagement with the respective plate cylinders 8, 10 while removing contact from the impression or printing cylinders 1, 2.

At least one drive gear is positioned, in any customary and suitable manner, on the shaft or on the shaft stubs of the cylinders. Preferably, the gear is a spiral or inclined gear teeth spur gear. The drive gears, for simplicity of illustration, have been given the same reference numerals as the cylinders to which they are splined, with a prime notation; thus, the gear for impression cylinder 1 is identified as 1'—see FIG. 3, for example.

The main drive for the 10-cylinder printing apparatus of FIG. 1 is obtained from a main drive shaft 11 on which a bevel gear 12 is mounted which drives a face or end gear 13. Thus, drive shaft 11 provides for right-angle drive transmission of rotation to gear 13. Gear 13 is the end point of the main drive gearing, and any other arrangement may be used to drive gear 13. In rubber blanket-impression cylinder operation, gear 13 is in engagement with a further gear 15. Gear 15, in that mode of operation, is either (a) directly in engagement with gear 2' of the first impression cylinder 2, or (b) for opposite direction of rotation, in engagement with a first rotation-reversal gear 18 which, in turn, drives the gear 2' of the first printing cylinder 2.

The second impression cylinder 1 is driven by a gear 20 which is in engagement with the gear 2' of the first impression cylinder; gear 20, selectively, drives the second impression cylinder 1 over its gear 1' either (a) directly; or (b) for reverse rotation, over a second rotation-reversal gear 19.

As can be seen, the direction of rotation of the respective first printing cylinder 2 and the second printing cylinder 1 can be selectively determined independently of each other.

When the apparatus operates in the rubber blanket—impression operating mode, the gears 1', 2', splined to the shafts of the impression cylinders 1, 2, also drive the gears 3', 4', 5', 6' of the respective blanket cylinders 3 to 6. Gears 3', 4' are driven over gear 1'; the gears 5', 6' of the blanket cylinders 5, 6 are driven by the gear 2'. As seen in FIG. 1, the plate cylinders 3 to 6 are driven by the blanket cylinders by similar gears 7', 8' meshing with the gears 3', 4', and gears 9', 10' of the plate cylinders 9, 10, meshing with the gears 5', 6' of the associated blanket cylinders 5, 6.

The 10-cylinder printing machine can be changed over for blanket—blanket mode of operation. The blanket cylinders 3, 4, 5, 6 are shifted or rocked out of contact with the impression cylinders 1, 2. Additionally, the gears 14 and 17 are axially shifted, so that gear 14 is brought into engagement with gear 13 to drive plate cylinder gear 9'. Since, now, the blanket cylinders 3 and 5 are in contacting engagement with each other, and the gears which are located on the respective shaft splines thereof, plate cylinder 9 can drive the blanket cylinder 5 via gears 9', 5'; blanket cylinder 5 can drive blanket cylinder 3 via gears 5', 3' which, then, can drive plate cylinder 7 via gears 3', 7'. Similarly, gear 16 in engagement with gear 15, driven from gear 13, can drive plate cylinder 10 via gear 15 and gear 16 after axial shifting of gear 17; gear 17, driving the gear 10' of plate cylinder 10, then can drive the respective rubber cylinders 6, 4 and the plate cylinder 8 similarly to the lower system, that is, via the respective gears 10'-6'-4'-8'.

Reversal of rotation of the printing cylinders 1, 2 only requires shifting of the gears 15 and 20 to engage, respectively, the printing cylinders 2, 1 directly, or via the rotation-reversal gears 18, 19. For blanket—blanket operation, however, it is only required to shift the gears 14, 17 so that these gears can drive the respectively connected cylinders 10, 6, 4, 8 and 9, 5, 3, 7 in directly connected gear trains.

Figure 2:
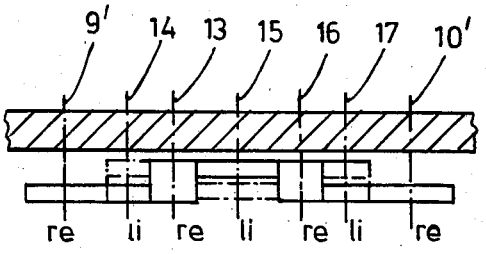

Connection of the respective gear trains in schematically shown in FIGS. 2–5, in which FIG. 2 illustrates the gear train arrangement for rubber—rubber mode of operation. One branch is formed by gear 13 in meshing engagement with the conical gear 12, and above the impression cylinders 1, 2, whereas the other branch is formed by gears below the impression cylinders 1, 2. As shown in FIG. 2, the upper branch is over gears 13–1-5–17 to gear 10' of the plate cylinder 10; gear 17, in its lower position as shown in FIG. 2, meshes with the gears 16 and 10'. The lower drive branch is as follows: Gear 13—gear 14 to gear 9' of plate cylinder 9; gear 14, in its lower, full-line position, meshes with the gear 13 and gear 9' of the plate cylinder 9.

To move the respective gears out-of-engagement, it is only necessary to move them into the position shown in chain-dotted lines.

Of course, and as well known, when using a drive with a multiplicity of gears, a shift in the profile of the gearing may be necessary. This shift in profile—in positive and negative direction—is indicated respectively, by a + or a − at the respective gear wheels, FIGS. 2–5. Further, for a better understanding of the operation, the direction of inclination of the spiral or slanted teeth of the drive gears is indicated; right-side slant is shown by r, and left-side slant by l. It is desirable to mount the spiral gears 7', 8', 9', 10' on the respective shafts so that their circumferential rotary position on the shaft can be adjusted with respect to the associated cylinders, so that exact matching of register can be obtained.

Figure 3:
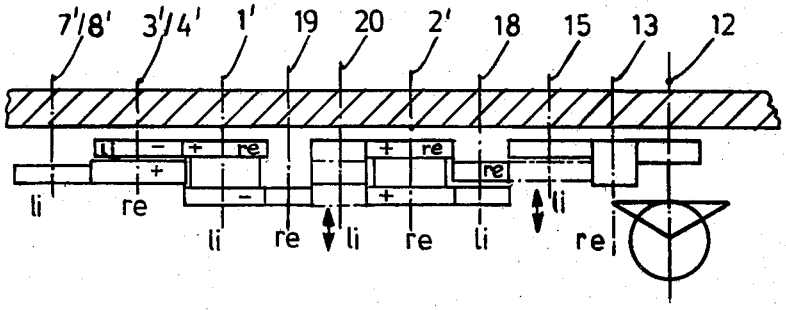

Operation of the gear train for blanket—impression cylinder operation is schematically shown in FIG. 3. The conical gear 12, only shown schematically, is in driving engagement with gear 13. From gear 13, gear 2' of the first impression cylinder 2 is driven over gears 15 and 18. Gear 2' is a double end gear, with the end gear wheels being spaced from each other, that is, the wheels are so located that they are in a first and in a third operating plane, respectively. In dependence on the desired direction of drive of the impression cylinder 2, drive is directly from gear 15 to the upper one of the gears 2'—with respect to FIG. 3—or via the reversal gear 18, in dependence upon whether gear 15 meshes with gear 18, or not, that is, directly engaging gear 2'. In the chain-dotted line position, FIG. 3, drive is effected over the reversal gear 18. FIG. 3 permits ready analysis of the further drive path of drive of the gear train; from gear 2' over the axially shiftable gear 20 directly to gear 1' of the impression cylinder 1 or, indirectly, via the reversal gear 19. The gear 1', again, has two gears located in a first and third operating plane, respectively. The left side of FIG. 3 shows that the gears 3', 4' of the blanket cylinders 3, 4, and the respective gears 7', 8' of the associated plate cylinders 7, 8 are driven from the impression cylinder 1.

As can be clearly seen in FIG. 3, the arrangement of the drive requires only three operating planes for the respective gears and gearing position, and no clutches.

Figure 4:
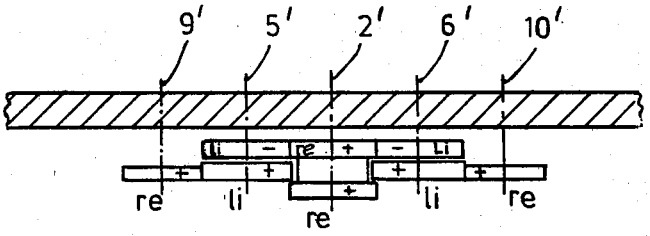

FIG. 4 shows the drive of the blanket cylinders 5, 6 over the respective gears 5', 6' from the first impression cylinder 2' for blanket-impression cylinder operation; gears 9', 10' of the associated plate cylinders 9 and 10 are driven from the respective gears of the associated blanket cylinders 5, 6.

Figure 5:
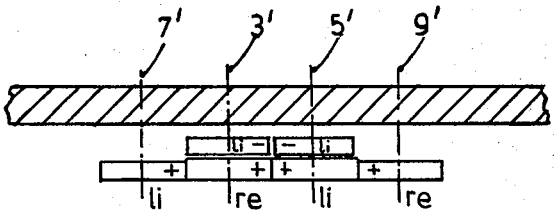

FIG. 5 illustrates the drive of the rubber and blanket cylinders 3, 5 and 7, 9 for blanket-blanket mode of operation. The lower one of the double gears 3', 5' of the blanket cylinders 3, 5 is in engagement with gears 7', 9' of the plate cylinders 7 and 9, which is automatically obtained upon shifting the centers of rotation of the blanket cylinders 3, 5 in FIG. 1 from full-line to broken-line position.

We claim:

1. Rotary offset printing machine having a printing system including four plate cylinders (7, 8, 9, 10):

four rubber cylinders (3, 4, 5, 6) and first and second impression cylinders (2, 1), whereby the printing system will have ten cylinders, said cylinders being rotatably supported with the axes of rotation of the rubber cylinders being movable;

axially movable drive gears (1'–10') positioned in driving engagement with respective cylinders, and comprising, in accordance with the invention, a main drive train (12, 13, 15);

a first rotation-reversal gear (18) located in rotation-transmitting position with respect to the main drive train;

the drive gear (2') on the first impression cylinder (2) having means, selectively, engageable with the main drive train directly, or via said first rotation-reversal gear (18);

a further drive gear (20) and a second rotation-reversal gear (19), the further drive gear being in driving connection with the first drive gear (2') of the first impression cylinder (2);

the drive gear (1') on the second impression cylinder (1) having means selectively, engageable with the further drive gear (20) directly, or via said second rotation-reversal gear (19);

a first drive train (14) having means selectively engageable with the main drive train (12, 13, 15);

a second drive train (16, 17) having means selectively engageable with the main drive train (12, 13, 15);

two each rubber cylinders (3, 4; 5, 6) of the four rubber cylinders forming, respectively, first and second pairs and having means movably journaled and located in symmetrically coordinate positions with respect to the first and second impression cylinders for selectively circumferential engagement with a respective impression cylinder (1, 2) or, for selective surface engagement of a rubber cylinder of one pair (3, 4) with a coordinate rubber cylinder (5, 6) of the other pair (3–5; 4–6) whereby the two engaging rubber cylinders will form rubber blanket—rubber blanket printing systems;

and wherein (a) for rubber-impression cylinder operation, the drive gears (3', 4'; 5', 6') of the pairs of rubber cylinders are selectively engageable with the drive gears (1', 2') of the impression cylinders, the plate cylinders associated with respective rubber cylinders being in driving engagement with the drive gears of the associated rubber cylinder (FIGS. 3, 4); and (b) for rubber cylinder—rubber cylinder operation, the first drive train (14) is, selectively, engageable with the drive gear (9') of the plate cylinder (9) associated with one rubber cylinder (5) of the second pair, the drive gear thereof being engageable with the drive gear (3') of one rubber cylinder (3) of the first pair, to form a first extended gear drive train (13-14-9'-5'-3'-7') (FIG. 5), and the second drive train (16, 17) is, selectively, engageable with the drive gear (10') of the plate cylinder (10) associated with the other rubber cylinder (6) of the second pair, the drive gear thereof being engageable with the drive gear (4') of the other rubber cylinder (4) of the second pair to form a second extended gear drive branch (15-16-17-10'-6'-4'-8').

2. Printing machine according to claim 1, wherein, for rubber cylinder-rubber cylinder operation, the plate cylinders (7, 8) of the first pair of the rubber cylinders (3, 4) are driven by gear engagement of the plate cylinder gears (7', 8') in driving engagement from the gear (3', 4') of the associated rubber cylinders (3, 4).

3. Printing machine according to claim 1, wherein the first extended gear drive branch (13-14-9'-5'-3'-7') comprises an axially shiftable spur gear (14) selectively engageable with the drive gear (9') of the plate cylinder (9) associated with said one rubber cylinder (5) of the second pair (5, 6) of rubber cylinders when operated in the rubber cylinder—rubber cylinder operation.

4. Printing machine according to claim 1, wherein the second extended gear drive branch (15-16-17-10'-6'-4-'-8') includes an axially shiftable spur gear (17) which is in engagement with the drive gear (10') of the plate cylinder (10) associated with the other rubber cylinder (6) of the second pair (5, 6) of rubber cylinders when operating in rubber cylinder—rubber cylinder operation mode.

5. Printing machine according to claim 1, wherein the gears (1', 2') associated with the impression cylinders (1, 2) comprise double spur gears.

6. Printing machine according to claim 1 wherein said drive gears are inclined tooth gears.

7. Printing machine according to claim 1, wherein the main drive train includes one axially shiftable gear (15), the axial position of said axially shiftable gear determining the relative driving engagement of said axially shiftable gear, directly, with the drive gear (2') of the first impression cylinder (2) or via the said rotation-reversal gear (18) in accordance with the axial position of said axially shiftable gear:

and the further drive gear (20) is axially shiftable and the axial position thereof determines the driving engagement of said further drive gear with the drive gear (1') on the second impression cylinder (1) selectively either directly or via said second rotation-reversal gear (19) to determine, selectively, the direction of rotation of the separate impression cylinder independently of the direction of rotation of said first impression cylinder.

8. Printing machine according to claim 1, wherein, to establish the respective operating directions of the drive gears (1'–10'), and hence of the respective cylinders coupled thereto, at least some of the gears of the drive trains (12, 13, 15; 14; 16, 17) and of the rotation-reversal gears (18, 19) are axially shiftable to provide, selectively, for predetermined direction of rotation of the cylinders driven by said drive trains and further transmission of driving power via the gears on the respective cylinders.

9. Printing machine according to claim 2 wherein said drive gears are inclined tooth gears.

10. Printing machine according to claim 5 wherein said drive gears are inclined tooth gears.

* * * * *